United States Patent [19]

Watanabe et al.

[11] Patent Number: 4,518,674

[45] Date of Patent: May 21, 1985

[54] DEVELOPING MATERIAL FOR ELECTROPHOTOGRAPHY, PROCESS FOR PREPARATION

[75] Inventors: Shotaro Watanabe; Makoto Tomono; Goichi Yamakawa, all of Tokyo; Takeo Nishimura, Saitama; Nobuo Takahashi, Tokyo, all of Japan

[73] Assignee: Konishiroku Photo Industry Co., Ltd., Tokyo, Japan

[21] Appl. No.: 592,752

[22] Filed: Mar. 26, 1984

Related U.S. Application Data

[63] Continuation of Ser. No. 196,057, Oct. 10, 1982, abandoned, which is a continuation of Ser. No. 922,235, Jul. 5, 1978, abandoned.

[30] Foreign Application Priority Data

Jul. 5, 1977 [JP] Japan ..... 52-80061

[51] Int. Cl.[3] ..... G03G 9/10

[52] U.S. Cl. ..... 430/108; 430/137; 148/31.5; 148/105; 148/6.3

[58] Field of Search ..... 430/108; 148/31.5, 105, 148/6.3, 6.35; 75/0.5 BA, 251

[56] References Cited

U.S. PATENT DOCUMENTS

| | | | |
|---|---|---|---|
| 3,093,039 | 6/1963 | Rheinfrank | 430/126 |
| 3,278,439 | 10/1966 | Blanchette et al. | 430/111 |
| 3,607,342 | 9/1971 | Sato | 430/121 |
| 3,615,340 | 10/1971 | Fuqua et al. | 75/0.5 BA |
| 3,632,512 | 1/1972 | Miller | 252/62.1 |
| 3,838,054 | 9/1974 | Trachtenberg et al. | 252/62.55 |
| 3,849,182 | 11/1974 | Hagenbach | 96/150 |
| 3,922,381 | 11/1975 | Datta | 427/216 |
| 3,970,571 | 7/1976 | Olson et al. | 430/108 |
| 4,030,913 | 6/1977 | Wegener | 75/0.5 BA |
| 4,125,667 | 11/1978 | Jones | 427/18 |
| 4,234,168 | 11/1980 | Kajinaga et al. | 266/137 |

OTHER PUBLICATIONS

Kubaschewski, O., et al., *Oxidation of Metals and Alloys*, Academic Press, p. 1, 1962.

Poster, A. R., *Handbook of Metal Powders*, pp. 56, 57 (1966).

*Primary Examiner*—John D. Welsh

*Attorney, Agent, or Firm*—James E. Nilles

[57] ABSTRACT

An iron powder developer carrier for electrophotography having at least the outer surface thereof coated with iron oxide. The iron oxide has a particle size of 50 to 200$\mu$, an apparent density of 1.5 to 2.5 g/cm$^3$ and a specific surface area of 0.01 to 0.3 m$^2$/g.

A process for the preparation of iron powder developer carriers for electrophotography, which comprises the steps of subjecting a starting iron powder to a primary calcination treatment in an inert gas atmosphere without using a binder, pulverizing and classifying said calcination product to prepare an intermediate iron powder, reducing the intermediate iron powder in a reducing atmosphere and washing the intermediate iron powder, and subjecting the intermediate iron powder to an oxidizing calcination treatment.

8 Claims, 4 Drawing Figures

DEVELOPING MATERIAL FOR ELECTROPHOTOGRAPHY, PROCESS FOR PREPARATION

This application is a continuation of application Ser. No. 196,057, filed Oct. 10, 1982, now abandoned, which is a continuation of Ser. No. 922,235, filed July 5, 1978, now abandoned.

The present invention relates to an iron developer carrier for electrophotography and a process for the preparation thereof and also to an image-forming method using this developer carrier. More particularly, the invention relates to a developer carrier suitable for developing an electrostatic latent image formed on an electrophotographic photosensitive plate of the transfer type comprising a photoconductive element, a developer including this developer carrier and an image-forming method using this developer carrier.

In the electrophotography, the surface of a photosensitive plate comprising a photoconductive element is uniformly charged in the dark and is exposed imagewise to actinic radiation to reduce the surface potential according to the relative energy in each area of the light image and provide a surface potential differing in respective areas in correspondence to the light image. Namely, an electrostatic latent image is formed on the photosensitive plate. This latent image is then visualized by contacting the latent image-bearing surface of the photosensitive plate with an appropriate developer. The method for developing an electrostatic latent image is roughly divided into two types, namely a so-called wet developing method using a liquid developer comprising an insulating organic liquid and a pigment or dye finely dispersed in the organic liquid and a so-called dry developing method, which is further divided into a method using a so-called toner which is a fine powdery developer comprising a coloring agent such as carbon black dispersed in a synthetic resin binder, such as a fur brush developing method, an impression method or a powder cloud method, and a method using a developer comprising such toner supported on a developer carrier composed of iron powder or glass beads, such as a magnetic brush method or a cascade method. When electrostatic latent images are developed according to these developing methods, image-developing substances having electric charges and being contained in developers adhere according to desired charge or discharge patterns. The adhering image-developing substances are permanently fixed on photosensitive plates by the action of heat, pressure or solvent vapor, or they are first transferred onto secondary elements such as transfer sheets and then permanently fixed thereon by similar means. According to the latter transfer method, the photosensitive plate is repeatedly used for formation of electrostatic latent images. In the transfer method, as the photosensitive plate, there are employed photosensitive plates formed by vacuum-depositing selenium or a selenium alloy on an appropriate support and photosensitive plates formed by coating a dispersion of fine powder of photoconductive zinc oxide in a film-forming resinous binder on an appropriate support. Electrostatic latent images formed on these photosensitive plates are developed according to the dry developing method, mainly the magnetic brush method or the cascade method.

In the magnetic brush method, the development is accomplished by using a non-magnetic cylindrical rotatory member having magnets fixed and attached to the inside thereof. This cylindrical member is arranged so that a part of the surface thereof is dipped in a developer supply source or is allowed to fall in contact with a developer by other means while it is being rotated, and a granular developer comprising a developer carrier and a toner is magnetically attracted to the surface of the cylinder. When the developer arrives at an area influenced by a magnetic field formed by the magnets contained in the cylinder, particles of the developer are arranged and aligned to form bristles resembling those of a brush. Since these bristles tend to orient in the direction of the magnetic flux, they stand vertically in the vicinity of the magnetic pole and they lie substantially horizontally on the outside of the periphery of the magnetic pole. The developer is attracted from the supply source and a part or all of the attracted developer is returned to the supply source while the continuously rotating cylinder makes one rotation. According to the above operation procedures, a fresh developer is always supplied to the point where the electrostatic latent image-bearing surface of the photosensitive plate falls in contact with the magnetic brush. In a typical rotation cycle, the cylinder passes through a series of the steps of sucking of the developer, formation of a magnetic brush, contact of the magnetic brush with an electrostatic latent image, breakdown of the magnetic brush and discharge of the developer. In the cascade method, a granular developer comprising a developer carrier and a toner is caused to flow-down on the electrostatic latent image-bearing surface of a photosensitive plate and fall in contact with said surface, whereby the development is accomplished.

In each of the magnetic brush method and the cascade method, a two-component type developer comprising a developer carrier and a toner is used as the developer. This developer is ordinarily a mixture comprising a toner composed of fine particles and a developer carrier composed of relatively large particles. For example, a developer carrier having a particle size of 50 to 200 $\mu$ is used in the magnetic brush method, and a developer carrier having a particle size of 200 to 700 $\mu$ is used in the cascade method. As the material of the developer carrier, there are used magnetic materials such as iron, nickel and cobalt and products obtained by forming resin coatings on the surfaces of these magnetic materials in the magnetic brush method and siliceous sands, glass beads and steel balls and products obtained by forming resin coatings on the surfaces of these materials in the cascade method. In general, toners having a particle size of 1 to 50 $\mu$ and being prepared by dispersing in a natural or synthetic resin a pigment such as carbon black or a dye such as a Nigrosine dye, if desired, together with a charge controlling agent for imparting a desirable frictional chargeability, a parting agent for preventing the phenomenon of offsetting of the toner to a fixing roller at a fixing step using the heated roller or other additive, are used in the magnetic brush method and the cascade method.

The developer carrier in the developer exerts the following functions. The developer carrier imparts a precise frictional charge polarity and an appropriate electric charge to the toner so that the toner is predominantly and selectively attracted to an electrostatic latent image to develop image areas at a high density and it provides a clear and sharp developed image by electrostatically reattracting the toner adhering to the non-image areas (the background) and removing such toner from the non-image areas. When at the developing step, the charge of the toner is low, the density of the image areas is high but the density is also high in the non-image areas. Namely, in this case, there is caused a disadvantage that so-called fogging is conspicuous and the resolving power is low. On the other hand, when at the developing step, the charge of the toner is high, fogging in the non-image areas is reduced and the resolving power is increased, but there is caused a defect of an insufficient density in the image areas. Since the quality of the resulting image is thus influenced by the quantity of the charge of the toner, it is very important to control the charge of the toner to a desirable level.

Various attempts have heretofore been made to maintain the quantity of the charge of a toner at a desirable level by selecting an appropriate pigment or toner to be incorporated into the toner and adjusting the amount of the pigment or dye so that the carrier can impart a quantity of the charge as uniform and constant as possible to the toner. Further, attempts have been made to control the frictional chargeability by improving a resinous component in the toner, and toner-preparing conditions have been examined and modified so that the dispersibility of the respective components of the toner can be improved and stabilized. When it is intended to control the frictional chargeability by improvements in the toner alone, no satisfactory results can be obtained. Therefore, attempts have also been made to improve characteristics of the developer carrier. For examples, there has been proposed and adopted a method in which the surfaces of particles of the developer carrier are coated with a resin having a high adherence to the surfaces of particles of the developer carrier but no stickness to the toner, being excellent in the abrasion resistance and having a uniform and appropriate frictional chargeability with the toner. As such resin, there are used, for example, ethyl cellulose, polyamides, poly(methyl methacrylate), polytrifluoroethylene, polytetrafluoroethylene and nitrocellulose.

Separately, various improvements have been made in the developing method with a view to obtaining high quality images. For example, there has been proposed a developing method in which a developing electrode is disposed in the developing zone and by applying a certain voltage (bias voltage), the electric field of an electrostatic latent image formed on the photosensitive plate is effectively utilized for the development through a developer carrier having an appropriate electric resistance. According to this developing method, a high quality image can be obtained and further, prints can be obtained at a high speed according to the image-transfer system. This developing electrode can be applied to both the magnetic brush method and the cascade method. The developing method using a developing electrode, however, involves a fatal defect that the life of the developer is shortened. Namely, in this developing method, the life of the developer is shortened to about 1/10 of the life of the developer in the developing method not using a developing electrode. The reason for shortening of the life of the developer is that the electric resistance of the developer is changed by the repeated use, resulting in degradation of characteristics thereof, and the effective bias voltage is changed by this degradation of the characteristics and the toner becomes hardly adherent to the photosensitive material, resulting in reduction of the density in the developed image. In short, the change of the bias voltage caused by degradation of the developer carrier is prominently manifested as degradation of the developing characteristics of the developer.

Degradation of the toner is due to both the causes in the toner and the causes in the developer carrier. For example, as regards the causes in the toner, the toner adheres to the surface of the developer carrier because of insufficient dispersion of such components of the toner as a pigment or dye, or the resin component of the toner is pulverized to fine powder and the surface of the developer carrier is contaminated with such resin powder, with the result that the frictional chargeability is adversely influenced. Such degradation of the toner causes, in turn, results in seeming increase of the electric resistance of the developer carrier, reduction of the effective value of the bias voltage and occurrence of fogging. Degradation of the developer which is due to causes in the toner can be moderated by appropriately selecting the composition of the toner-constituting components or the toner-preparing conditions.

In the developing method using a developing electrode, in order to prevent loss of static charges of the electrostatic latent image, it is necessary that the developer carrier should have an appropriate electric resistance. For this reason, an iron powder developer carrier is mainly used. This developer carrier, however, is defective in that the frictional chargeability with the toner is not stable and fogging is readily caused. Namely, the electric resistance of the iron powder developer carrier tends to increase gradually while it is being used, and therefore, the bias voltage is reduced and fogging is caused to occur. As means for overcoming this defect of the iron powder developer carrier, there has been proposed a method in which an oxide film is formed on the surface of the iron powder by subjecting the iron powder to an oxidation treatment. The electric resistance of the so treated iron powder developer carrier is more stable than the electric resistance of the unoxidized iron powder developer carrier, and the life or durability of the developer can be improved and fogging can be substantially prevented. However, considerably complicated process steps are required for obtaining an iron powder developer carrier having a desirable electric resistance by the above-mentioned surface oxidation, and control of these steps is very difficult. For example, in the process disclosed in the specification of U.S. Pat. No. 3,767,477, 5 steps should be conducted while such conditions as the oxidizing atmosphere and temperature are being strictly controlled, and therefore, the operations are much complicated and controls for attaining desirable characteristics in the products involve various difficulties. Moreover, the characteristics of the resulting iron powder developer carrier are not always satisfactory. More specifically, when a developer comprising an iron powder developer carrier having on the surface thereof an oxide film formed by the conventional oxidizing treatment is used repeatedly for the transfer type development continuously at a high speed through there can be obtained results better than the results obtained by the use of a developer comprising a non-surface-treated iron powder developer, the change of the electric resistance of the developer carrier is still conspicuous and the frictional chargeability with the toner is still unstable. Accordingly, defects of reduction of the density of the developed image and occurrence of fogging are not eliminated. Namely, when electrostatic latent images formed on a photographic photosensitive plate are developed continuously at a high speed according to the transfer system by using a developing electrode, degradation of characteristics of the developer carrier is combined with degradation of characteristics of the toner and also with the change of the memory of the photosensitive material, i.e., degradation of one of characteristics of the photosensitive material, because of the repeated use thereof, and as a result, the developing capacity is synergistically degraded promptly and reduction of the image density and occurrence of fogging cannot be avoided in the developed images. Accordingly, the life or durability of the conventional developers is still insufficient for obtaining a plurality of prints continuously at a high speed, and the conventional developers are not satisfactory from the practical viewpoint.

Recently, attempts have been made to improve developing characteristics of developers. For example, Japanese Patent Application Laid-Open Specification No. 15537/73 discloses a method for improving a metal powder carrier to be used for a developer. According to this method, fine powder of iron or nickel is mixed with an inorganic substance such as sodium silicate, an organic polymer such as a polymer of styrene, and alkyl acrylate or vinyl chloride or a solvent solution of polyvinyl alcohol or the like, the mixture is pelletized, the pellets are dried at about 125° C., and when the inorganic substance is used as the binder, the dried pellets are further calcined at 1250° to 1300°.

It is taught that when the so-prepared developer carrier is used for a developer, the frictional chargeability with a toner, the durability of the developer and the image characteristics can be improved.

However, since the developer carrier prepared according to this method is ordinarily coated with an insulating binder, the electric resistance is too high and preferred electric characteristics cannot be obtained. Further, it is difficult to apply a bias voltage at the image-forming step. Thus, this developer carrier still involves defects to be overcome.

When iron powder is used as a material of a developer carrier, corrosion advances promptly in areas not sufficiently coated with a binder, and hence, there is observed a defect that fatigue or degradation of the developer carrier is readily caused.

As will be apparent from the foregoing illustration, a developer carrier having truly desirable developing characteristics or a developer comprising such developer carrier has not been developed in the art.

It is a primary object of the present invention to provide a developer carrier having a stabilized frictional chargeability with a toner and being capable of remarkably improving image-developing characteristics and durability of a developer.

Another object of the present invention is to provide a developer carrier capable of forming an excellent image having a high density with much reduced fogging, a developer comprising such developer carrier and a toner as the main components and an image-forming method using such developer.

Still another object of the present invention is to provide a developer capable of forming clear and sharp images having a high density consistently when a plurality of prints are prepared at a high speed according to the transfer system, in which fatigue or degration is not caused even if development is carried out by applying a bias voltage, and an image-forming method using such developer.

In accordance with the present invention, the foregoing and other objects of the present invention can be attained by an iron powder developer carrier for electrophotography having at least the outer surface thereof coated with iron oxide, which has a particle size of 50 to 200 $\mu$, an apparent density of 1.5 to 2.5 g/cm$^3$ and a specific surface area of 0.01 to 0.3 m$^2$/g, preferably 0.03 to 0.20 m$^2$/g.

Other features and advantages of the present invention will be apparent from the following description made by reference to the accompanying drawings.

The drawings illustrate electron-microscope photographs of iron powder developer carriers, in which.

For the developer carrier of the present invention, reduced iron powder, iron oxide powder or iron nitride powder is used as the starting substance, and such starting substance is pulverized to particles having a size not exceeding 50 $\mu$. Such pulverized starting substance is subjected to preliminary calcination at a temperature of 900° to 1200° C. in a current of an inert gas such as nitrogen gas or argon gas, preferably in a current of a reducing gas such as hydrogen gas. The resulting calcined product is pulverized and sieved to collect intermediate iron powder having a particle size of 50 to 200 $\mu$. When iron oxide powder or iron nitride powder is present in this intermediate iron powder, it is reduced in a hydrogen gas current to form reduced iron powder. Then, if necessary, impurities such as dusts and soluble impurities are removed by washing with water and/or an organic solvent. Then, the intermediate iron powder is oxidized and calcined in an oxygen gas current at a temperature of 280° to 390° C. to form a coating film of an iron oxide, preferably diiron trioxide or triiron tetroxide.

Figure 1:
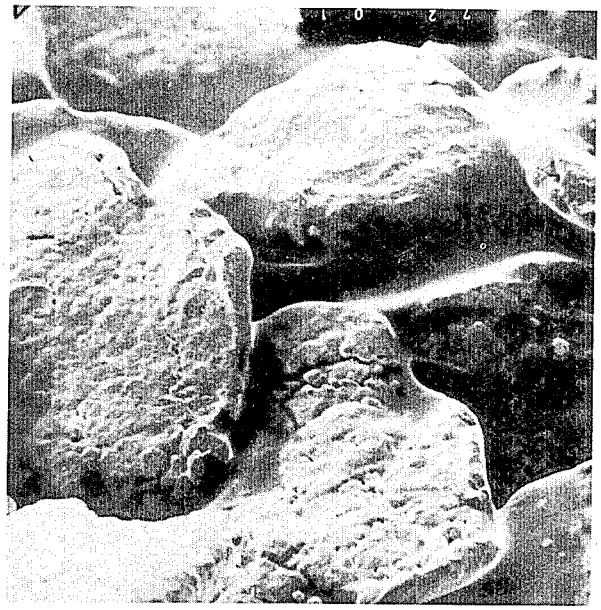
FIG. 1 is an electron-microscope photograph (600 magnifications) of surfaces of particles of a conventional iron powder developer carrier.

Particles of the iron powder developer carrier prepared according to the above-mentioned specific process of the present invention are different from particles of the conventional iron powder developer carrier shown in FIG. 1 in the point that the surfaces of the particles are porous and scale-like convexities and concavities are present on the surfaces of the particles. The apparent density of the developer carrier of the present invention is lower than that of the conventional developer carrier and is in the range of from 1.5 to 2.5 g/cm$^3$. The specific surface area of the developer carrier of the present invention is larger than that of the conventional developer carrier and is in the range of from 0.01 to 0.3 m$^2$/g., preferably 0.03 to 0.20 m$^2$/g. Further, the area covered with an iron oxide film in the developer carrier of the present invention should naturally be larger than that in the conventional iron powder developer.

Developer carriers consisting of spherical and smooth particles have heretofore been preferably employed. In view of this fact, it is quite surprising that a developer carrier consisting of such modified particles exerts excellent effects as regards the frictional chargeability, durability and image quality.

When the iron powder developer carrier of the present invention is used for the copying operation in a copying machine of the repeated transfer type, even if images are continuously formed under application of a bias voltage, no variation of the effective bias voltage is caused, and therefore, the bias effect can be sufficiently attained and prints of a high image quality can be obtained consistently.

The reasons why such excellent effects can be attained by the iron powder developer carrier of the present invention have not been completely elucidated. However, it is construed that the internal structure of a developer carrier composed of iron oxide powder prepared according to the above-mentioned specific process is quite different from that of the conventional iron oxide-covered developer carrier, the developer carrier of the present invention is composed of agglomerates of fine sintered particles, and since surfaces of these sintered particles are covered with iron oxide coating films, the surface area of the iron oxide-covered particles of the developer carrier is increased and as a result, the surfaces of the developer carrier particles have much better electric characteristics than those of the surfaces of the particles of the conventional developer carrier. It also is believed that by virtue of such excellent surface characteristics of the developer carrier of the present invention, when it is used for production of a developer, it is possible to obtain a developer excellent in the moisture resistance, durability and image characteristics.

For the production of the developer carrier of the present invention, a starting iron material such as mentioned above is pulverized to obtain a fine starting iron powder having a particle size not exceeding 50 $\mu$. If the particle size of the starting iron powder is larger than 50 $\mu$, a developer carrier having a desirable particle structure or desirable development characteristics cannot be obtained even if the subsequent steps are conducted according to the process of the present invention. Therefore, in this case, the intended effects of the present invention cannot be attained.

The so prepared iron powder is not subjected to a treatment with a known binder such as mentioned above, for example, sodium silicate, polystyrene, poly(acrylic acid ester) or polyvinyl alcohol, but it is directly subjected to a primary calcination treatment in a current of an inert gas, preferably a reducing hydrogen gas current, at a temperature of 900° to 1200° C. Then, the calcined product is cooled, pulverized and classified to collect particles having a size of 50 to 200 $\mu$. According to need, the so prepared intermediate iron powder is reduced in a hydrogen gas current and washed with a solvent such as water, an organic solvent or a surface active agent, and it is then dried by hot air or in a reduced pressure atmosphere. Then, the dried particles are oxidized and calcined at a temperature of 280° to 390° C. to form oxide films on the surfaces of the particles. The reason why the primary calcination treatment is conducted in a reducing atmosphere is that when the staring iron powder is composed of iron oxide or iron nitride, it is regenerated to reduced iron powder at the step of the calcination treatment. Even if reduced iron powder is used as the starting iron powder, it is often converted to iron oxide or the like by water or oxygen contained in air during the treatment. Accordingly, such iron oxide is regenerated to reduced iron powder by conducting the primary calcination treatment in a reducing gas current.

It is not always indispensable that this reducing treatment should be conducted at the primary calcination step, but it is possible to adopt a method in which the primary calcination is carried out in a current of an inert gas and the resulting intermediate iron powder is subjected to a reducing treatment at the subsequent step prior to the oxidizing calcination.

The washing treatment of the intermediate iron powder may be conducted before or after the oxidizing calcination. This washing treatment is conducted for removing impurities, dusts and machine oil-soluble salts contained in the iron powder to thereby improve electrophotographic characters of the iron powder developer carrier.

Oxide films formed by the oxidizing calcination impart an appropriate electric resistance to the iron powder and when the resulting developer carrier is used in combination with a toner, by the presence of the oxide films, the frictional chargeability with the toner, the moisture resistance, the mechanical and electric durability and the image characteristics can be remarkably improved. Therefore, in the present invention, the above-mentioned oxidizing calcination treatment for forming oxide films is indispensable.

In order to attain the intended objects of the present invention, it is necessary that the developer carrier prepared according to the above-mentioned process should have an apparent density of 1.5 to 2.5 g/cm$^3$ as determined according to a measurement method described below and a specific surface area of 0.01 to 0.3 m$^2$/g, preferably 0.03 to 0.20 m$^2$/g, as determined according to a measurement method described above.

[Measurement of Apparent Density]

The apparent density is determined according to the "Method for Measurement of Apparent Density of Metal Powder" specified in Z-2504-1966 of the Japanese Industrial Standards (JIS).

More specifically, the measurement is carried out by using a measurement apparatus comprising a powder flow-down funnel including an orifice having a predetermined diameter and a cylindrical cup for receiving a metal powder falling down from the funnel, said cup having a depth of 40 mm and a volume of 25±0.05 cm$^3$. A sufficiently dried metal powder is caused to flow-down into the cup through the funnel until the metal powder is charged in the cup to the opening mouth thereof. The weight of the charged metal powder is weighed by a balance, and the obtained value is multiplied by 0.04 to obtain a value of the apparent density expressed in terms of g/cm$^3$.

[Measurement of Specific Surface Area]

A nitrogen gas is adsorbed in a mono-molecular layer in the sample according to the BET adsorption method using a specific surface area analyzing apparatus (Model OR 2100-A manufactured by Shimazu Seisakusho), and the total surface area of the sample is calculated from the number of adsorbed nitrogen molecules and the area occupied by one molecule. The unit of the sodetermined value of the specific surface area is m$^2$/g.

Although the apparent density and specific surface area of the developer carrier are influenced by the particle size of the starting iron powder, the calcination temperature and the particle size of the intermediate iron powder, in order to obtain a developer carrier having the apparent density and specific surface area within the abovementioned ranges, it also is important to select an appropriate pulverizing machine.

As the pulverizing machine that is preferably used in the present invention, there can be mentioned, for example, a roll pulverizer, a ball mill pulverizer and an impact pulverizer.

Even if an intermediate iron powder having desirable apparent density and specific surface area is obtained by appropriately setting such conditions as the particle size of the starting iron powder, the calcination temperature and the particle size of the intermediate iron powder, the intended developer carrier of the present invention cannot be obtained unless the oxidizing calcination is carried out under appropriate conditions.

Supposing that the apparent density is higher than 2.5 $g/cm^3$ and the specific surface area of the particles of the developer carrier is smaller than 0.01 $m^2/g$, the concavities or convexities (the porous characteristic), which constitute one of important features of the developer carrier of the present invention, are not manifested, and hence, the surface area of the iron oxide films is decreased. Accordingly, excellent development characteristics and durability cannot be attained at all. In the case where the apparent density is lower than 1.5 $g/cm^3$ and the specific surface area is larger than 0.3 $m^2/g$, the convexities and concavities formed on the surfaces of particles of the developer carrier become excessive, and simultaneously, the particle size is extremely reduced. Accordingly, particles of the developer carrier adhere to the surface of the photosensitive layer during the developing treatment, causing such troubles as breakdown of the photosensitive layer. For the foregoing reasons, it is important in the present invention that the developer carrier should have an apparent density of 1.5 to 2.5 $g/cm^3$ and a specific surface area of 0.01 to 0.3 $m^2/g$, preferably 0.03 to 0.02 $m^2/g$.

The carrier particles of the present invention is finally subjected to the oxidizing calcination treatment in an oxidizing atmosphere to form oxide films having a volume resistivity of an order of $10^9$ to $10^{10}\Omega$-cm, which is sufficient to resist application of a bias voltage to the developer carrier. By the presence of such oxide films, the frictional chargeability with the toner, the durability and the voltage resistance can be remarkably improved.

Figure 2:
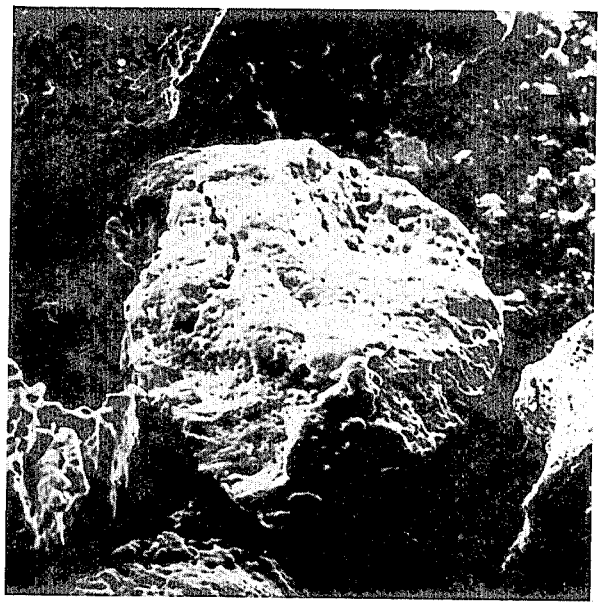
FIG. 2 is an electron-microscope photograph (600 magnifications) of surfaces of particles of an iron powder developer carrier according to the present invention.
Figure 3:
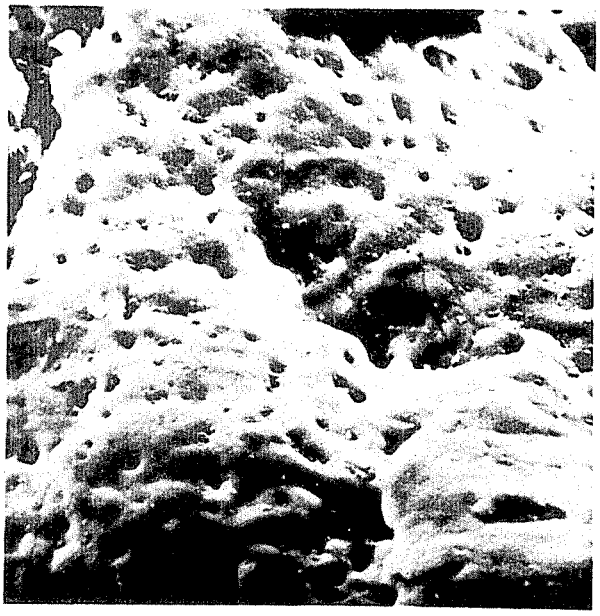
FIG. 3 is an electron-microscope photograph (3000 magnifications) of surfaces of particles of an iron powder developer carrier according to the present invention.
Figure 4:
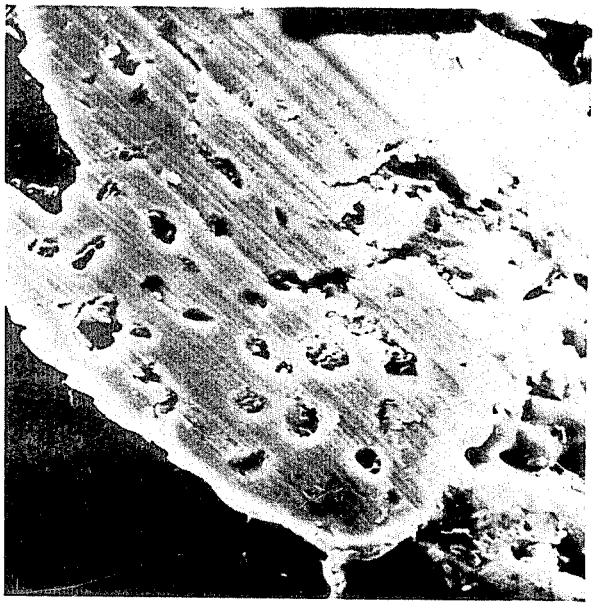
FIG. 4 is an electron-microscope photograph (3000 magnifications) of sections of particles of an iron powder developer carrier according to the present invention.

The developer carrier of the present invention prepared according to the above-mentioned process is distinguishable over conventional developer carriers in the point that convexities and concavities are formed on the surfaces of the carrier particles, and we have confirmed that a great number of convexities and concavities are formed on the surfaces of particles as shown in FIGS. 2 to 4. It is believed that the surface area of the particles is increased by the presence of these convexities and concavities.

When this developer particle is mixed with a toner to form a developer, toner particles are electrically attached to the surfaces of the particles of the developer carrier and in addition, the toner particles can be included in the concavities formed on the surfaces of the porous particles of the developer carrier. It is construed that such toner particles can moderate the fatigue of not only the developer carrier but also the toner for some or other unknown reason.

The developer that is used in the present invention is obtained by blending a toner into the iron powder developer carrier prepared according to the above-mentioned process. As the toner, there can be used a fine powder of a composition obtained by incorporating and dispersing in a natural or synthetic resin a coloring agent composed of a pigment such as carbon black or a dye and if desired, a charge controlling agent for controlling the frictional chargeability. As the resin that can be used, there can be mentioned, for example, rosin, gilsonite, a phenol-formaldehyde resin, a rosin-modified phenol-formaldehyde resin, a methacrylic resin, a polystyrene resin, a polyethylene resin, a polypropylene resin, an epoxy resin, a coumarone-indene resin, asphalt, a polyamide resin, a polyurethane resin, a polyester resin, a styrene-acrylic copolymer, a styrene-methacrylic acid ester copolymer and mixtures thereof. Carbon black is most popular as the coloring agent. Instead of carbon black, there may be employed, for example, Nigrosine dyes, Aniline Blue, Chalco Oil Blue, Chrome Yellow, Ultramarine Blue, Du Pont Oil Red, Quinoline Yellow, Methylene Blue chloride, Phthalcyanine Blue, Malachite Green oxalate, lamp black, Rose Bengale and mixtures thereof. The coloring agent should be incorporated into a toner in an amount sufficient to color the toner to such an extent that a visible image is formed by the development. As the charge controlling agent that is added according to need, there is ordinarily used a certain kind of a dye or pigment. For example, as the agent for imparting a positive frictional chargeability to a toner particle, there can be used dyes described in Japanese Patent Publication No. 2427/66, such as Fat Schwartz HBN (color index No. 26150), alcohol-soluble Nigrosine (color index No. 50415), Sudan Chief Schwartz BB (color index No. 26150), Brilliant Spirit Schwartz TN (manufactured by Bayer AG) and Zapon Schwartz X (manufactured by Hoechst AG). As the agent for imparting a negative frictional chargeability to a toner particle, there can be used dyes such as Celes Schwartz (R) G (manufactured by Bayer AG), Chromogene Schwartz ETCO (color index No. 14645) and Azo Oil/Black R (R) (manufactured by National Aniline Co.) and metal-containing dyes such as Phthalocyanine Blue. When a heated roller is used at the fixing step, a parting agent is used for preventing occurrence of the offset phenomenon. As such parting agent, there can be used, for example, metal salts of fatty acids and low-molecular-weight polyalkylene resins, and such parting agent is incorporated into the toner.

A toner having a composition such as mentioned above can be prepared, for example, by mixing and kneading the respective components by using a hot roll, cooling the kneaded mixture, pulverizing the cooled mixture and calssifying the resulting particles to collect particles having a desirable particle size. In general, the average particle size of the toner is adjusted to 1 to 50$\mu$, preferably 2 to 30$\mu$. In the developer of the present invention, an optional toner can be used. The mixing ration of the toner to the iron power carrier is ordinarily 2 to 5% based on the developer when the developer is applied to the magnetic brush method or 0.5 to 2% by weight based on the developer when the developer is applied to the cascade method.

When an electrostatic latent image is developed by using the above-mentioned developer of the present invention, a clear and sharp image having a very high density with much reduced fogging can be obtained in either the magnetic brush method or the cascade method. Especially when the developer of the present invention is applied to the magnetic brush method using a developing electrode, even if a great number of prints are continuously formed according to the transfer system, the characteristics of the developer can be maintained over a long period and clear and sharp images having a high density and being free of fogging can always be obtained, and the durability or life of the developer can be remarkably improved or prolonged.

The composition of the developer of the present invention is not substantially different from that of the conventional two-component type developer, but the characteristics of the developer carrier to be used for production of the developer are different from those of the developer carrier used for the conventional developer and hence, the latitude of the mixing ratio of the developer carrier and the toner, necessary for obtaining desirable image characteristics, can be remarkably broadened. More illustratively, in the conventional developer, if the toner is incorporated in an amount of 10 to 15 parts per 100 parts of the developer carrier, fogging is caused and the resulting developer cannot be put into practical use. On the other hand, in case of the developer of the present invention, even if the amount of the toner is large, a high density image with reduced fogging can be obtained. This is one of advantages of the developer of the present invention. Further, the developer comprising the developer carrier of the present invention is hardly influenced by the spent toner and even after a great number of prints have been obtained, fatigue of the developer is not substantially caused and the bias voltage can be applied to the photosensitive material and developer as effectively as in the initial stage of the copying operation. Therefore, occurrence of fogging can be effectively prevented and excellent images can be formed.

The developer of the present invention can be applied to not only an electrostatic latent image formed on a known photoconductive photosensitive material including as a photoconductor selenium, titanium oxide, cadmium sulfide or zinc oxide but also an electrostatic latent image formed on an electrostatic recording sheet having no photosensitivity at all.

The present invention will now be described in detail by reference to the following Example that by no means limits the scope of the present invention.

EXAMPLE

Two kinds of starting iron powders having a particle size smaller than 50μ and a particle size smaller than 100μ, respectively, were prepared, and they were treated while changing the primary calcination temperature, the particle size after the primary calcination and the oxidizing calcination temperature as indicated in Table 1, whereby 14 kinds of iron powders were formed. With respect to each of the so obtained iron powders, the apparent density and specific surface area were determined according to the methods described hereinbefore. Obtained results are shown in Table 1.

TABLE 1

| Sample No. | Particle Size (μ) of Starting Iron Powder | Primary Calcination Temperature (°C.) | Particle Size (μ) of Intermediate Iron Powder | Oxidizing Calcination Temperature (°C.) | Apparent Density (g/cm³) | Specific Surface Area (m²/g) |
|---|---|---|---|---|---|---|
| | | Sample of Present Invention | | | | |
| 1 | below 50 | 1050 | 50–200 | 300–370 | 2.18 | 0.029 |
| 2 | below 50 | 1100 | 50–200 | 300–370 | 2.22 | 0.028 |
| 3 | below 50 | 900 | 50–200 | 300–370 | 1.80 | 0.11 |
| 4 | below 50 | 1200 | 50–200 | 300–370 | 2.30 | 0.020 |
| | | Comparative Sample | | | | |
| 5 | below 50 | 850 | 50–200 | 300–370 | 1.43 | 0.42 |
| 6 | below 50 | 1300 | 300 | 300–370 | 3.10 | 0.0013 |
| 7 | below 50 | 750 | below 50 | 300–370 | 1.35 | 0.50 |
| 8 | below 100 | 950 | 50–200 | 300–370 | 2.60 | 0.0070 |
| 9 | below 100 | 1100 | 50–200 | 300–370 | 2.62 | 0.0068 |
| 10 | below 50 | 1100 | above 200 | 300–370 | 2.95 | 0.0022 |
| 11 | below 50 | 1100 | above 200 | 300–370 | 2.80 | 0.0036 |
| 12 | below 50 | 1000 | 50–200 | 250–280 | 2.01 | 0.056 |
| 13 | below 50 | 1150 | 50–200 | 250–280 | 2.70 | 0.0050 |
| 14 | below 50 | 950 | 50–200 | 250–280 | 1.80 | 0.11 |

Developers having a composition indicated below were prepared by using the so prepared iron powder developer carriers, and the copying operation was carried out by using these developer in a commercially available copying machine (Model U-BIX 1500). The number of obtained prints, the image quality and the occurrence of fogging were examined to obtain results shown in Table 2.

Composition of Developer:

Iron powder developer carrier—100 parts

Toner—6 parts

Incidentally, the toner used comprised of a styrene resin, carbon black and a Nigrosine dye at a mixing weight ratio of 100:6:4.

TABLE 2

| Sample No. | Results of Copying Operation: Number of Prints | Occurrence of Fogging |
|---|---|---|
| | Samples of Present Invention | |
| 1 | 20000 | not observed |
| 2 | 20000 | not observed |
| 3 | 20000 | not observed |
| 4 | 20000 | not observed |
| | Comparative Sample | |
| 5 | 5000 | observed |
| 6 | 6000 | observed |
| 7 | 10000 | observed |
| 8 | 8000 | observed |
| 9 | 6000 | observed |
| 10 | no good image was formed | |
| 11 | 3000 | observed |
| 12 | 7000 | observed |
| 13 | 4000 | observed |
| 14 | 4000 | observed |

From the data shown in Table 1, it will readily be understood that if any of the requirements of the particle size of the staring iron powder, the primary calcination temperature (°C.) and the particle size of the intermediate iron powder is outside the range specified in the present invention, the conditions of the apparent density and specific surface area, specified in the present invention, are not satisfied in the resulting developer carrier. Further, even when the foregoing treatment conditions and the conditions of the apparent density and specific gravity are satisfied, if the oxidizing calcination conditions are outside the range specified in the present invention, the intended objects of the present invention cannot be attained.

From the results of Table 2 obtained when samples of the present invention and comparative samples were used for the continuous copying operation conducted in the commercially available copying machine, it will readily be understood that in case of samples of the present invention, 1 fogging is not caused at all even if 20000 prints are formed by the continuous copying operation, whereas in case of comparative samples, fogging is caused when 10000 or a less number of prints are formed by the continuous copying operation, and the image quality is degraded by occurrence of fogging.

What is claimed is:

1. A process for the preparation of iron powder developer carriers for electrophotography, which comprises the steps of subjecting a starting iron powder pulverized to a particle size smaller than 50μ to a primary calcination treatment at a temperature of 900° to 1200° C. in an inert gas atmosphere or reducing gas atmosphere without using a binder, to thereby form a calcination product, pulverizing and classifying said calcination product to prepare an intermediate iron powder having a particle size of 50 to 200μ, if necessary, reducing the intermediate iron powder in a reducing atmosphere and washing the intermediate iron powder with at least one member selected from the group consisting of water, a solution containing surface active agents and organic solvents, and subjecting the intermediate iron powder to an oxidizing calcination treatment at a temperature of 280° to 390° C. said process being free of the application of a coating to said powder particles.

2. A process for the preparation of iron powder developer carriers for electrophotography according to claim 1 wherein the product obtained by said oxidizing calcination treatment is washed with at least one member selected from the group consisting of water, a solution containing surface active agents and organic solvents.

3. An iron powder developer carrier for electrophotography prepared by the process of claim 1, wherein said carrier is not provided with a resin coating.

4. A developer for electrophotography comprising the iron powder developer carrier of claim 3 and a toner, said developer carrier having a particle size of 50 to 200μ, an apparent density of 1.5 to 2.5 g/ $cm^3$ and a specific surface area of 0.01 to 0.3 $m^2/g$, wherein said carrier is free of resin coating except that transferred thereon from said toner.

5. A developer for electrophotography as set forth in claim 4, wherein the toner is present in the developer in an amount of 2 to 10 parts per 100 parts of the developer carrier present in the developer.

6. An image-forming method comprising developing an electrostatic latent image formed on a photoconductive photosensitive material by using a developer comprising a developer carrier and a toner, if necessary under application of a bias voltage, said developer carrier being the iron powder developer carrier of claim 3 a particle size of 50 to 200μ, an apparent density of 1.5 to 2.5 $g/cm^3$ and a specific surface area of 0.01 to 0.3 $m^2/g$, to thereby form a visible image, and heat-fixing said visible image directly as it is or after it has been transferred onto a transfer sheet.

7. The iron powder developer carrier for electrophotography of claim 3 having a particle size of 50 to 200μ, an apparent density of 1.5 to 2.5 $g/cm^3$ and a specific surface area of 0.01 to 0.3 $m^2/g$.

8. An iron powder developer carrier for electrophotography as set forth in claim 7, wherein particles of the iron powder developer carrier are porous particles.

* * * * *